US005149283A

United States Patent [19]

Nakazawa

[11] Patent Number: 5,149,283

[45] Date of Patent: Sep. 22, 1992

[54] PLUG AND SOCKET

[75] Inventor: Yasuo Nakazawa, Maebashi, Japan

[73] Assignee: Hosiden Corporation, Osaka, Japan

[21] Appl. No.: 763,546

[22] Filed: Sep. 23, 1991

[30] Foreign Application Priority Data

Sep. 27, 1990 [JP] Japan ..... 1-101472

[51] Int. Cl.[5] ..... H01R 13/648

[52] U.S. Cl. ..... 439/607; 439/680

[58] Field of Search ..... 439/101, 108, 607, 608, 439/660, 677, 678, 680, 681

[56] References Cited

U.S. PATENT DOCUMENTS

| | | | |
|---|---|---|---|
| 4,500,159 | 2/1985 | Briones et al. | 439/607 |
| 4,595,251 | 6/1986 | Moulin | 439/680 X |
| 4,611,873 | 9/1986 | Punako et al. | 439/607 X |
| 4,630,876 | 12/1986 | Grunberg et al. | 439/680 X |
| 4,643,509 | 2/1987 | Hollyday et al. | 439/607 |
| 4,938,718 | 7/1990 | Guendel | 439/680 |
| 4,974,075 | 11/1990 | Nakajima | 439/607 X |

*Primary Examiner*—Larry I. Schwartz
*Assistant Examiner*—Khiem Nguyen
*Attorney, Agent, or Firm*—Pollock, VandeSande and Priddy

[57] ABSTRACT

In a plug, an insulating body is disposed in a cylindrical metallic shield cover, a plurality of signal contacts and two power supply contacts are held by the insulating body axially thereof and are separated by a square-sectioned partition wall extending from the insulating body. The front end face of the partition wall lies forwardly of the tips of the contacts.

In a socket to which the plug is put, a plurality of signal contacts and two power supply contacts are held by an insulating body axially thereof. A cylindrical metallic member is mounted in the body in a manner to surround the contacts. In the cylindrical member a columnar key extends forwardly from the insulating body on the center axis of the cylindrical member. The power supply contacts are housed in slots made in said columnar key and extending rearwardly from its front end face. Support plates extend from the insulating body on both sides of the columnar key in opposed but spaced relation thereto, and the signal contacts are housed in housing grooves cut in the support plates on one sides thereof and extending axially thereof. The tips of the power supply contacts and the signal contacts lie short of the front end portions of the columnar key and the support plates.

8 Claims, 8 Drawing Sheets

PLUG AND SOCKET

BACKGROUND OF THE INVENTION

The present invention relates to a plug which is almost free from short-circuiting between its power supply contacts and signal contacts by foreign objects, and a socket into which the plug is put.

FIG. 1 shows a conventional plug, in which contacts 12 are held by and project out from a body 11 of an insulating material fixedly housed in a cylindrical metallic shield cover 13. The contacts 12 extend in the cylindrical shield cover 13 to the vicinity of its forward end.

FIGS. 2 and 3 show a conventional socket, in which contacts 18 are housed in contact housing holes 17 made in a columnar portion 16 inside a cylindrical groove 15 cut in the front of a socket body 14 of an insulating material. The columnar portion 16 has cut in its peripheral surface a main positioning groove 19*a* and sub positioning grooves 19*b* and 19*c* extending lengthwise thereof. In the traditional plug which is put into such a socket, the contacts 12 have their forward end exposed in the vicinity of the forward end of the shield cover 13. In order for the plug and the socket to connect therethrough the power supply line as well, it is necessary to provide power supply contacts as well as the signal contacts 12 in the plug body 11 and to house the corresponding power supply contacts in contact housing holes made in the columnar portion 16 of the socket body 14. In the plug of such a construction, however, there is a possibility that when a conductive foreign object happens to enter into the cylindrical shield cover 13 of the plug, even though slightly, the contacts are shorted by the foreign object. In particular, shorting between the signal contact 12 and the power supply contact is very likely to destroy signal circuits of electronic equipment connected to each of the plug and the socket.

SUMMARY OF THE INVENTION

An object of the present invention is to provide a plug which is free from shorting between power supply contacts and signal contacts.

Another object of the present invention is to provide a socket in which it is difficult to adhere a foreign object to contacts, and hence shorting is hard to occur between signal contacts.

The plug of the present invention has a construction in which power supply contacts and signal contacts are separated by a partition wall of an insulating material and the forward end face of the partition wall lies forwardly of the forward ends of the power supply contacts and the signal contacts.

The socket of the present invention has a construction in which a partition wall receiving groove for receiving the partition wall of the mating plug is formed in the body of an insulating material between power supply contacts and signal contacts.

DESCRIPTION OF THE PREFERRED EMBODIMENTS

Figure 1:
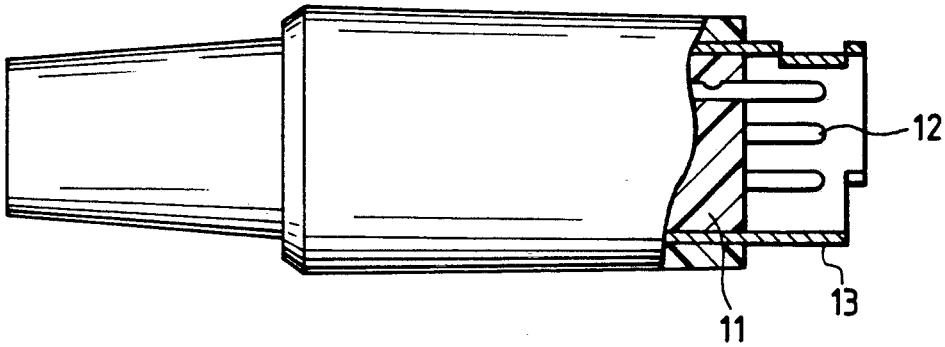
FIG. 1 PRIOR ART
FIG. 1 is a side view, partly broken away, showing a conventional plug.
Figure 2:
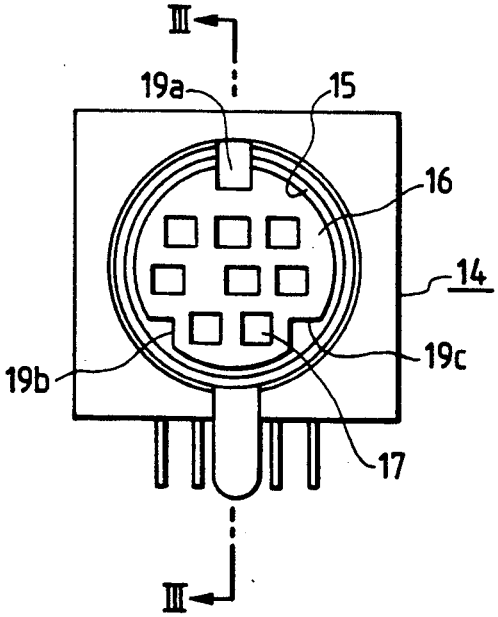
FIG. 2 PRIOR ART
FIG. 2 is a front view of a conventional socket.
Figure 3:
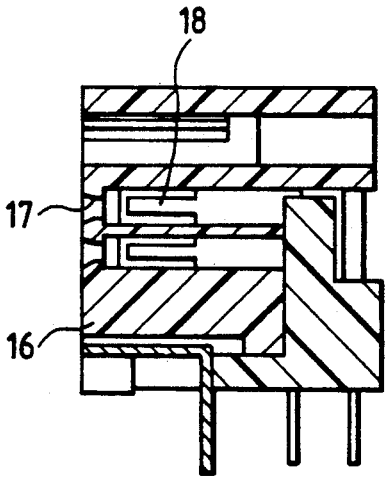
FIG. 3 PRIOR ART
FIG. 3 is a sectional view taken on the line III—III in FIG. 2.
Figure 4:
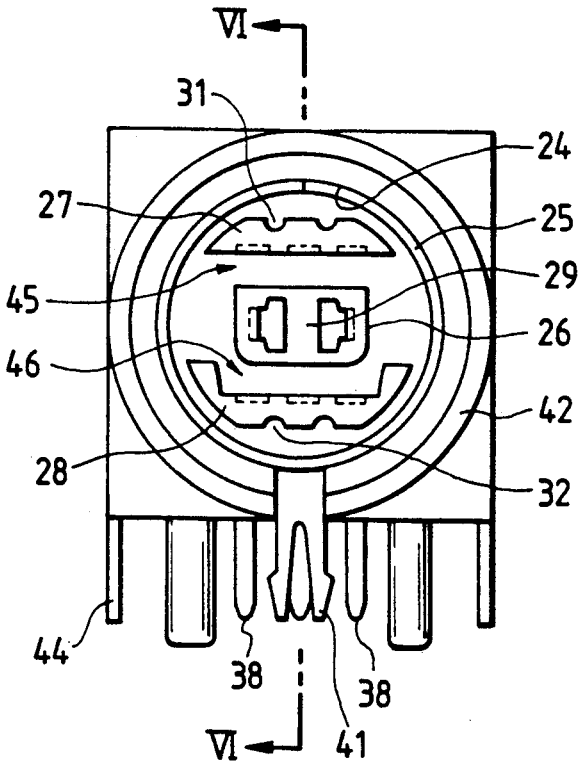
FIG. 4 is a front view illustrating an example of the socket according to the present invention.
Figure 5:
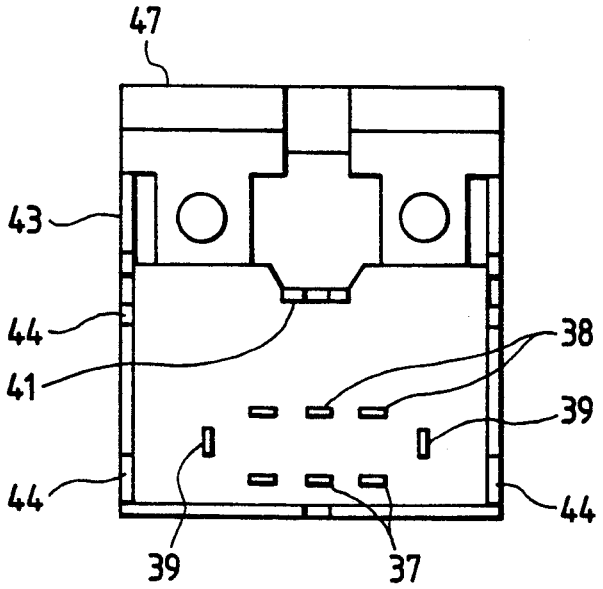
FIG. 5 is a bottom view of the socket shown in FIG. 4.
Figure 6:
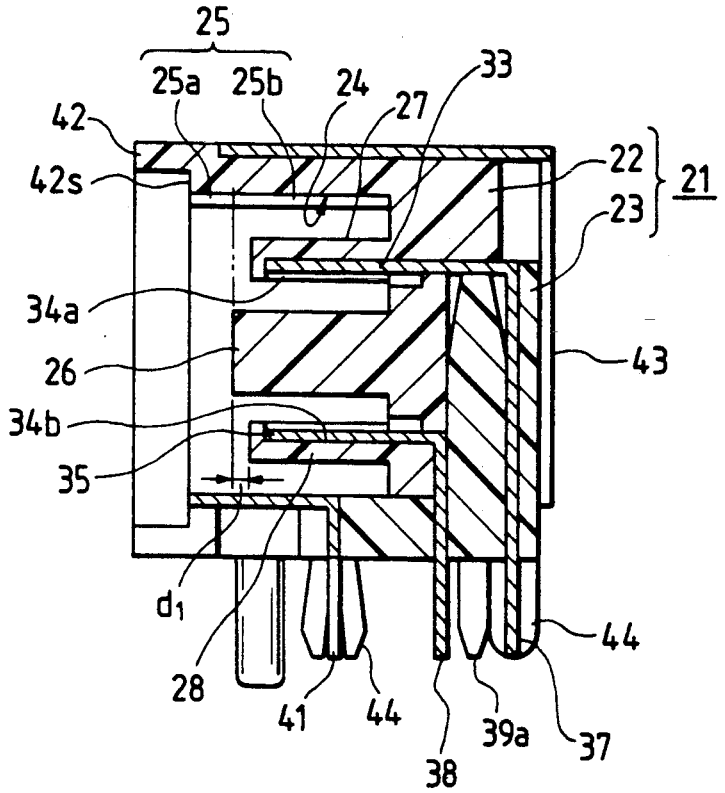
FIG. 6 is a sectional view taken on the line VI—VI in FIG. 4.

FIGS. 4 through 7 illustrate an embodiment of the socket according to the present invention. A body 21 of an insulating material has a rectangular parallelpipedic configuration and includes a contact holding portion 22 and a terminal lead portion 23 for external connection of contact terminals as shown in FIG. 6. The terminal lead portion 23 is L-shaped and has its vertical portion abutted on the back of the contact holding portion 22 and its horizontal portion abutted on the bottom of the contact holding portion 22.

The body 21 has in its front a circular hole 24, in which a cylindrical metal member 25 is held in contact with its interior surface. A columnar key 26, substantially rectangular in section and formed integrally with the body 21, extends forwardly thereof from the bottom of the circular hole 24 centrally thereof. The columnar key 26 has its two adjacent corners rounded so that it can be inserted into a key hole of an insulating body of the mating plug at only one rotational angular position. If the columnar key 26 is not at a specified rotational angular position relative to the key hole of the mating plug put into the socket, then the front end face of the columnar key 26 abuts against the front end face of the insulating body of the mating plug, preventing it from further insertion into the socket. The contact holder 22 has formed integrally therewith contact support plates 27 and 28 opposite the top and bottom of the columnar key 26, respectively.

The columnar key 26 has two parallel slots 26*a* , 26*b* extending axially from its front end face on both sides of a partition wall 29. The lower contact support plate 28 has edge flanges 28*a* and 28*b* raised from its both sides substantially along the inner wall of the circular hole 24 in spaced relation thereto to a position slightly higher than the plane containing the bottom of the columnar key 26. The upper contact support plate 27 is substantially flat and its two sides extend along the inner surface of the circular hole 24 in spaced relation thereto. In the top of the upper contact support plate 27 and the bottom of the lower contact support plate 28 there are cut two guide grooves 31 and 32, respectively, which extend length-wise thereof.

Figure 7:
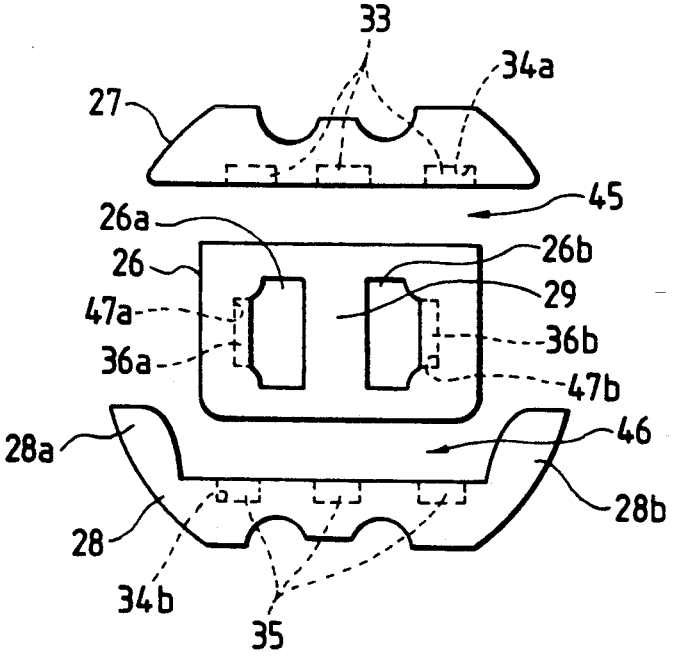
FIG. 7 shows, on an enlarged scale, the front end faces of a columnar key 26 and contact support plates 27 and 28.

The contact support plates 27 and 28 have cut therein three axially extending contact housing grooves 34*a* and 34*b* opposite the columnar key 26, in which there are housed three signal contacts 33 and 35 as depicted in FIGS. 6 and 7. The tips of the contact support plates 27 and 28 project out forwardly of the tips of the signal contacts 33 and 35. In the case where the mating plug has been turned about 180 degrees from its correct rotational angular position, the front end faces of the edge flanges 28*a* and 28*b* of the contact support plate 28 stand adjacent the front end face of the plug, and if the plug is forced into the socket, then the confronting end faces abut against each other, blocking the forced insertion of the plug.

In left and right inner walls of the slots 26*a* and 26*b* made in the columnar key 26, as shown in FIG. 7, there are cut contact housing grooves 47*a* and 47*b* extending axially thereof, in which power supply contacts 36*a* and 36*b* are housed and supported. As depicted in FIGS. 5 and 6, rear end portions of the signal contacts 33 and 35 and the power supply contacts 36*a* and 36*b* are bent downward so that they extend through the terminal lead portion 23 and project out the bottom of the body 21 as terminals 37, 38, 39*a* and 39*b*, respectively. The cylindrical member 25 also has a terminal 41 projected out of the bottom of the terminal lead portion 23.

To prevent the front end portions of the contact support plates 27 and 28 from being abraded by the front end edge of a cylindrical metal shield cover of a mating plug during the rotational angular positioning of the mating plug relative to the socket, the front end face of the columnar key 26 protrudes forward more than the front end faces of the contact support plates 27 and 28 by $d_1$. The front marginal portion of the cylindrical metal member 25 protrudes further than the front end face of the columnar key 26 to define a plug guide portion 25*a*, by which the cylindrical shield cover of the mating plug fitted thereinto is guided, with the axis of the shield cover aligned with the axis of the cylindrical member 25, until the front end face of the insulating body of the plug comes into abutment with the front end face of the columnar key 26. The rear of the plug guide portion 25*a* of the cylindrical metal member 25 defines a shield cover receiving portion 25*b* into which the cylindrical shield cover of the plug is inserted further after the columnar key 26 engages with the plug.

The front marginal portion of the body 21 projects further than the front marginal edge of the cylindrical metallic member 25 to form a sleeve 42 coaxial with the circular hole 24. The inside diameter of the sleeve 42 is larger than the inside diameter of the circular hole 24 to facilitate putting the mating plug therein. The front edge of the cylindrical member 25 is flush with a stepped portion 42*s* formed between the inner surfaces of the circular hole 24 and the sleeve 42 or projects a little forwardly thereof so that the front marginal edge of the metal shield cover of the mating plug does not abrade the inner marginal edge of the stepped portion 42*s*.

The body 21 is covered with a metal cover 43, except its front and bottom. A terminal 44 of the cover 43 projects out downward from the bottom of the body 21. The columnar key 26 and the contact support plates 27 and 28 define therebetween partition wall receiving grooves 45 and 46, into which partition walls forming a square-sectioned wall of the mating plug are inserted, with the columnar key 26 aligned with the key hole of the plug.

Figure 10:
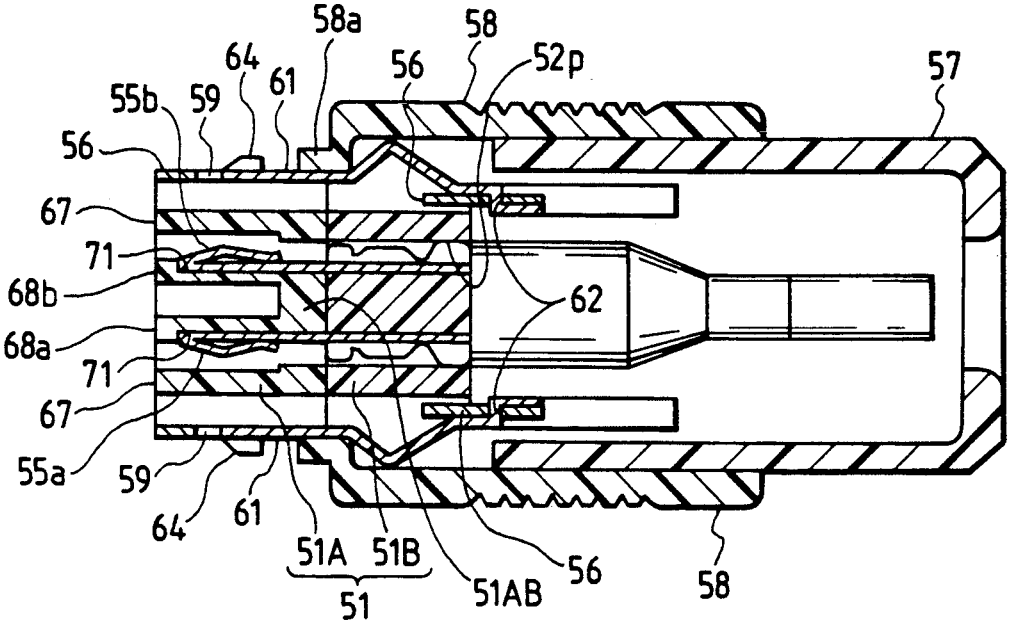
FIG. 10 is a sectional view taken on the line X—X in FIG. 8.
Figure 11:
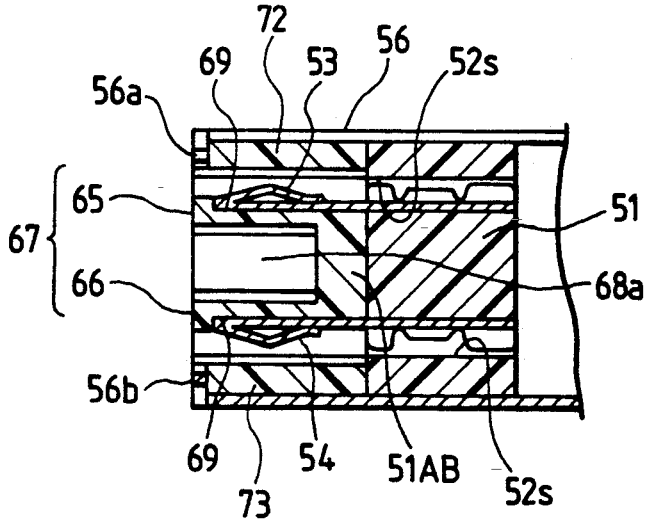
FIG. 11 is a sectional view taken on the line XI—XI in FIG. 8.

FIGS. 8 through 11 illustrate an embodiment of the plug according to the present invention. As shown in FIGS. 10 and 11, a substantially columnar body 51 of an insulating material in this example is composed of separate front and rear half portions 51A and 51B, which are coupled in tandem at a predetermined rotational angular position relative to each other by coupling means not shown. The front half portion 51A of the body 51 includes a rear end wall 51AB, a substantially rectangular-sectioned tubular wall 67 extending forwardly from the front of the rear end wall 51AB substantially centrally thereof, guide plates 72 and 73 which extend forwardly from the rear end wall 51AB and are opposite at one side to upper and lower partition walls 65 and 66 each forming part of the rectangular-sectioned tubular wall 67 and each form at the other side a part of the outer peripheral surface of the columnar body 51. Flat support arms 68*a* and 68*b* are extending forwardly from the rear end wall 51AB in parallel but spaced relation to each other inside the rectangular-sectioned tubular wall 67. The hole inside the rectangular-sectioned tubular wall 67 is substantially rectangular and its two adjacent corners are rounded to define a key hole 67k for receiving the columnar key 26 of the socket.

There are bored through the rear body half portion 51B and the rear end wall 51AB two upper and lower rows of three contact housing holes 52*s* (see FIG. 11), which are contiguous to contact housing grooves 69 flush with them and cut in the outer faces of the upper and lower partition walls 65 and 66. There signal contacts 53 and three signal contacts 54 are received in and extended through both the contact housing holes 52*s* and the contact housing grooves 69. Similarly, there are bored through the rear body half portion 51B and the rear end wall 51AB two contact housing grooves 52*p*, which are contiguous to contact housing grooves 71 cut in the outer surfaces of the flat support arms 68*a* and 68*b*. Two power supply contacts 55*a* and 55*b* are received in and extended through both the contact housing holes 52 and the contact housing grooves 71. The contacts 53, 54, 55*a* and 55*b* have their forward end portions folded back to form contact portions protruding from the grooves 69 and 71.

The body 51 is fixedly received in a cylindrical shield cover 56, with the front end faces of the rectangular-sectioned tubular wall 67 and the support arm 68*a* and 68*b* held in line with the front edge of the cylindrical shield cover 56. The front end faces of the guide plates 72 and 73 are a little behind the front end face of the rectangular-sectioned tubular wall 67, and protective bars 56*a* formed by partially cutting and bending the front marginal edge of the shield cover 56 are provide in front of the front end faces of the guide plates 72 and 73. The rear half portion of the shield cover 56 is fixedly received in a cylindrical cap 57 of an insulating material. A cylindrical coupling 58 of an insulating material is put on the cap 57. The coupling 58 has its front marginal portion reduced in its inner diameter to form a small-diametered portion 58*a* which is slidable on the shield cover 56 in its axial direction.

The shield cover 56 has cut therein two axially elongated holes 59 at diametrically opposite positions. A pair of flexible levers 61 have free forward end portions respectively disposed in elongated holes 56 and rear end portions engaged with a slit 62 made in the shield cover 56 near its rear end. The intermediate portion of each lever 61 is bent outwardly in a triangular form and protrudes toward the interior surface of the coupling 58 in front of the front edge of the cap 57, and each lever 61 has a pair of lugs 64 which protrude from its forward end in front of the small-diametered portion 58*a* of the cylindrical shield cover 58 radially outwardly thereof. When the plug is put into the socket of FIGS. 4–7, the lugs 64 engage holes (not shown) made in the side wall of the cylindrical member 25 of the socket, thus locking the plug to the socket. The plug can be unlocked from the socket simply by pulling the coupling 58 backward. That is, when the coupling 58 is pulled back, the small-diametered portion 58*a* of the cylindrical shield cover 58 urges the triangularly-bent portion of each lever 61 inwardly, and consequently, the lugs 64 are also displaced inwardly and disengaged from the above-mentioned holes, thus unlocking the plug from the socket.

The upper and lower partition walls 65 and 66 of the rectangular-sectioned tubular wall 67 separate the signal contacts 53, 54 and the upper power supply contacts 55*a*, 55*b* and these walls are fitted into grooves 45 and 46 of the socket. The partition wall 66 protrudes from the rectangular-sectioned tubular wall 67 on both sides thereof to the inner wall surface of the shield cover 56. As shown in FIG. 11, the fold edges of the signal contact 53 and 54 are held against forward end faces of the contact housing grooves 69 made in the partition walls 65 and 66 in the axial direction thereof, and hence they are mechanically protected when the partition walls 65 and 66 of the plug are inserted into the slots 26*a* and 26*b* of the socket. The contact portions of the signal contacts 53 and 54 protrude from the grooves 69 as mentioned previously, so that they can readily come into contact with the mating contacts 33 and 34 when the plug is put into the socket. The power supply contacts 55*a* of the plugs and 55*b* are also protected by the support arms 68*a* and 68*b*, respectively, and their contact portions make contact with the power supply contacts 36*a* and 36*b* of the socket.

To ensure proper positioning and coupling of the plug to the socket, guide plates 72 and 73 of an insulating material are disposed in adjacent but spaced relation to the partition walls 65 and 66, respectively. The guide plates 72 and 73 have, on the inside thereof, axially elongated protrusions 74 and 75 formed integrally therewith. The outer peripheral surface of each of the guide plates 72 and 73 is held in contact with the interior surface of the shield cover 56. The forward end faces of the rectangular-sectioned tubular wall 67, the support arms 68*a*, 68*b* and the shield cover 56 are positioned in about the same plane. The rectangular-sectioned tubular wall 67, the support arms 68*a*, 68*b* and the guide plates 72, 73 are formed as a unitary structure with the rear end wall 51AB of the front half portions 51A of the body 51, and this structure is attached to the front of the rear half portion 51B of the body 51 in an abutment manner. The front half portion 51A and the rear half portion 51B of the body 51 may also be formed as a unitary structure.

Figure 12:
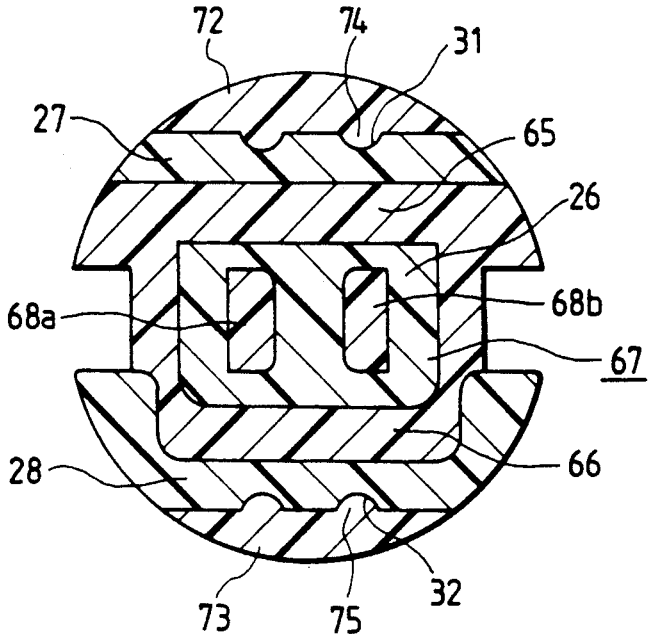
FIG. 12 is a sectional view showing the coupling of the socket of FIG. 4 and the plug of FIG. 8 at right angles to their axes.

Upon putting the plug into the socket, when the tip end portion of the shield cover 56 of the plug is inserted into the sleeve 42 of the socket and a part of the marginal edge of the shield cover 56 abuts against the stepped portion 42*s*, the other remaining part of the marginal edge of the shield cover 56, which does not abut against the stepped portion 42*s*, slightly enters into the cylindrical member 25 of the socket, and consequently, the center axis of the plug is slightly inclined with respect to the center axis of the socket. As a result of this, the force applied to the plug acts to slide the shield cover 56 in a direction that brings the center axis of the plug toward the center axis of the socket, facilitating entrance of the tip end portion of the shield cover 56 into the cylindrical member 25 of the socket. As the plug is further pressed into the socket, the center axis of the shield cover 56 naturally gets into alignment with the center axis of the cylindrical member 25, and as described previously, the front end face of the rectangular-sectioned tubular wall 67 abuts against the front end face of the columnar key 26 of the socket. Then, the plug is turned to a certain rotational angular position, where the columnar key 26 is fitted into the key hole 67*k* inside of the rectangular-sectioned tubular wall 67, so that the plug can be further pressed into the socket. After the shield cover 56 is thus fitted into the cylindrical member 25, the columnar key 26 is received in the rectangular-sectioned tubular wall 56, the support arms 68*a* and 68*b* are received in the slots 26*a* and 26*b*, the contact support plate 27 is held between the partition wall 65 and the guide plate 72, the contact support plate 28 is held between the partition wall 66 and the guide plate 73, and the elongated protrusions 74 and 75 are received in the guide grooves 32 and 31, as depicted in FIG. 12. The respective dimensions of the socket and plug are chosen accordingly. When the plug and the socket are thus coupled, the signals contacts 33, 35 of the socket and the signal contacts 53 and 54 of the plug are in contact with each other, and the power supply contacts 36*a*, 36*b* of the socket and the power supply contacts 55*a*, 55*b* of the plug are in contact with each other.

Figure 13:
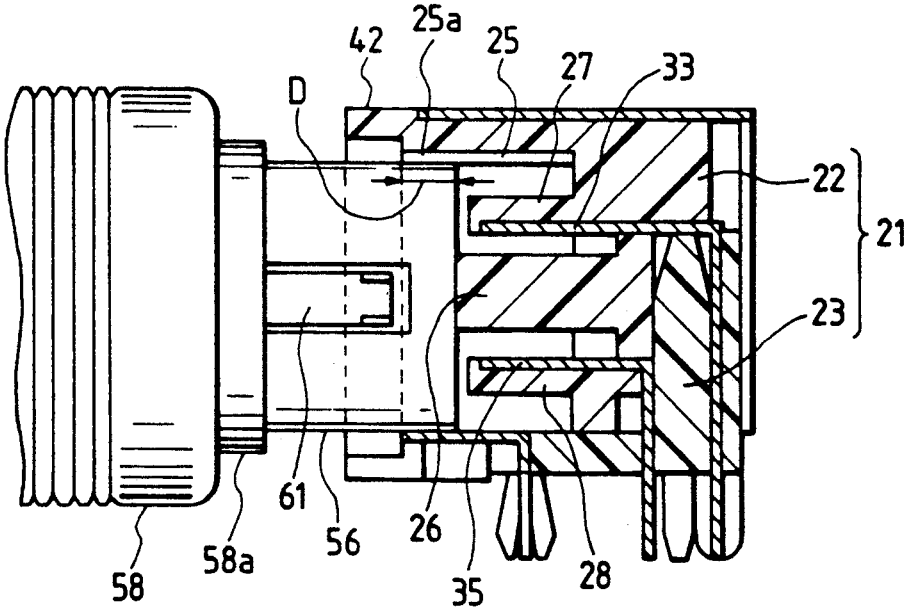
FIG. 13 is a side view illustrating the state of insertion of the forward end portion of the plug into a plug guide portion of the socket shown in section.

When the plug is being put into the soket, the plug can easily be brought to a specified rotational angular position by turning it about its axis, with the shield cover 56 of the plug received in the cylindrical member 25 of the socket as shown in FIG. 13. In addition, the front marginal edge of the shield cover 56 does not abrade any insulating material portions of the socket during the rotational angular positioning.

Figure 8:
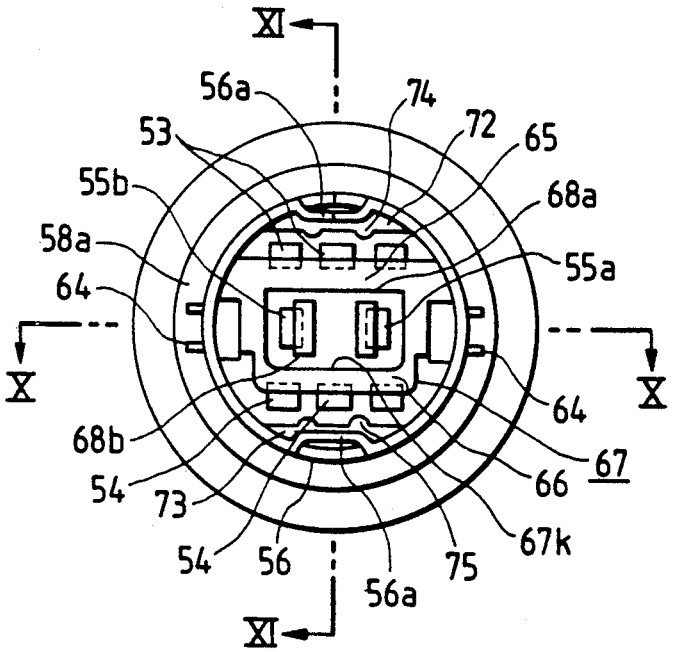
FIG. 8 is a front view illustrating an example of a plug according to the present invention.
Figure 9:
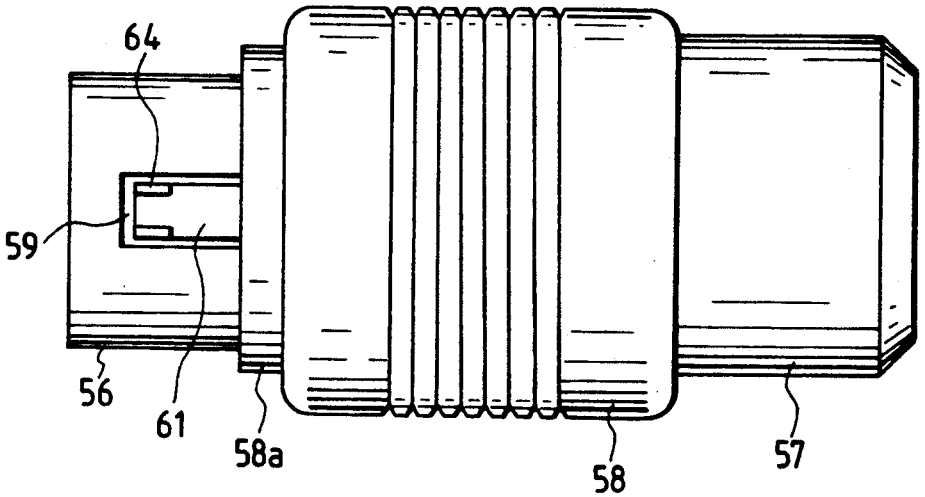
FIG. 9 is a right side view of the plug depicted in FIG. 8.
Figure 14:
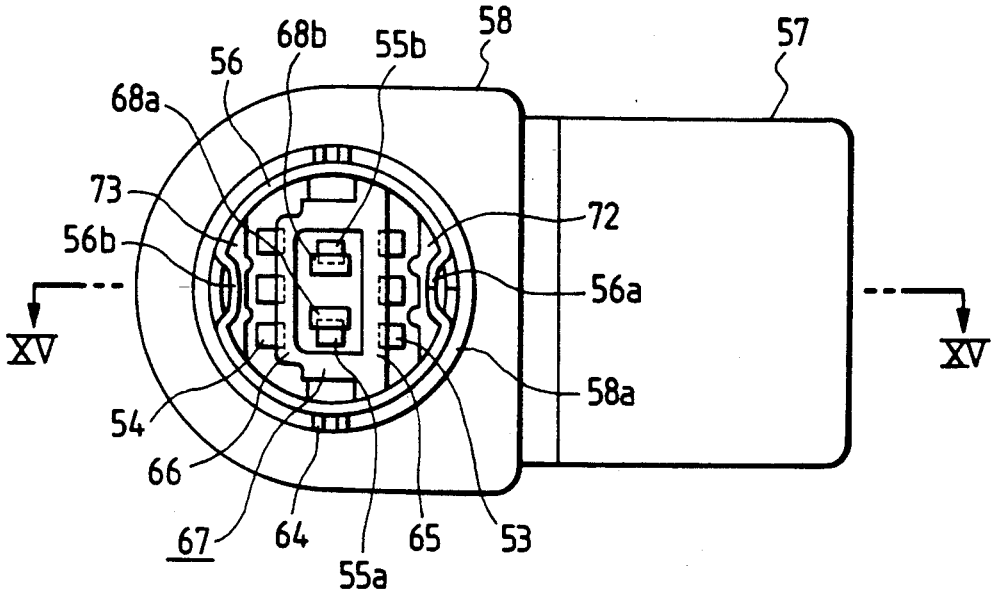
FIG. 14 is a front view illustrating another example of the plug.
Figure 15:
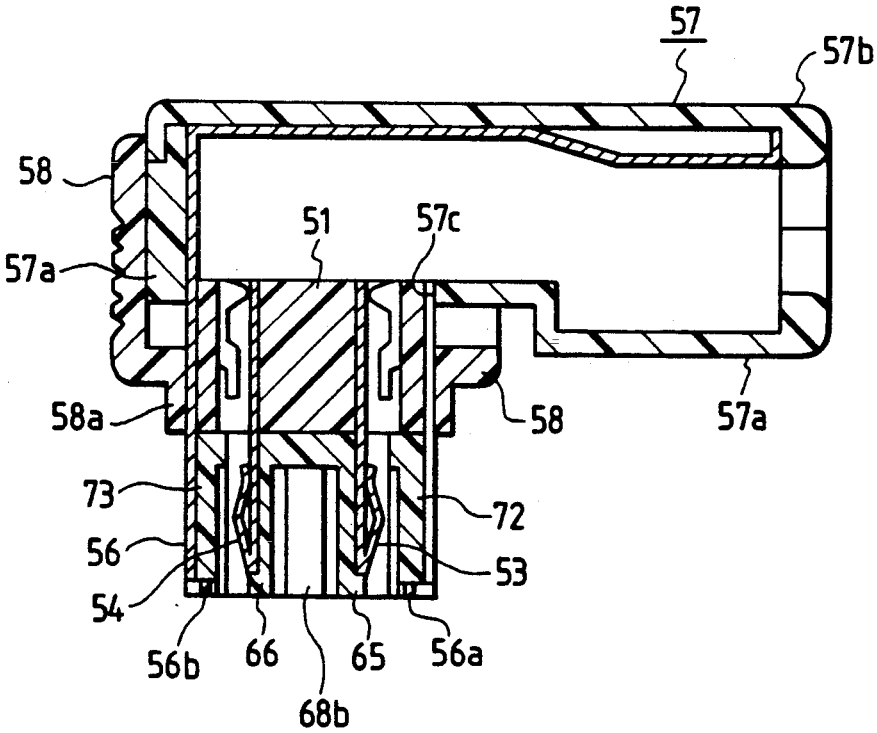
FIG. 15 is a sectional view taken on the line XV—XV in FIG. 14.

In the above example the plug is put into and pulled out of the socket in the axial direction of the cap 57 and a cable having conductor wires (not shown) connected to the contacts is led out of the rear end face of the cap 57, but the plug may also be so constructed that a cap 57 of substantially rectangular parallelpipedic shape extends from the plug body at right angles to its axis, as depicted in FIGS. 14 and 15 in which the parts corresponding to those in FIGS. 8 and 11 are identified by the same reference numerals. In this instance, the non-extended side of the cap 57 is semicylindrical. A circular hole 57*c* coaxial with the semicylindrical face is made in the front end portion of the cap 57 and the rear end portion of the cylindrical member 56 is received in the circular hole 57*c*. The inside of the cylindrical member 56 is formed to have the same construction as that of the plug described above, and a coupling 58 having a small-diametered portion 58*a* through which the cylindrical member 56 is inserted, is mounted to cover the semicylindrical portion of the cap 57. The cap 57 is composed of a case portion 57*a* from which the cylindrical member 56 projects and a lid portion 57*b* for covering the case portion 57*a*. A cable (not shown) is led out through a hole made in the end face of the cap 57 on the opposite side from its cylindrical end face.

The levers 61 lock the plug to the socket. When the cylindrical member 56 of the plug is inserted into the cylindrical member 25 of the socket to a predetermined position, the lugs 64 are engaged with small holes (not shown) made in the cylindrical member 25, by which the plug is prevented from being pulled out of the socket. The plug can be unlocked from the socket by pulling the coupling 58 backward. As in the above-described embodiment, the front marginal portion of the coupling 58 is reduced in diameter to form the small-diametered portion 58*a* serving as an engaging ring. The inner peripheral surface of the ring 58*a* is substantially in contact with the outer peripheral surface of the cylindrical member 56, and the triangular bent portions of the levers 61 are positioned in the large-diametered portion of the coupling 58 behind the ring 58*a*. Accordingly, when the coupling 58 is pulled back, the triangular bent portions of the levers 61 are displaced inwardly by the rear edge of the ring 58*a* and the lugs 64 are disengaged from the small holes in the cylindrical member 25 of the socket, thus unlocking the plug from the socket.

Figure 16:
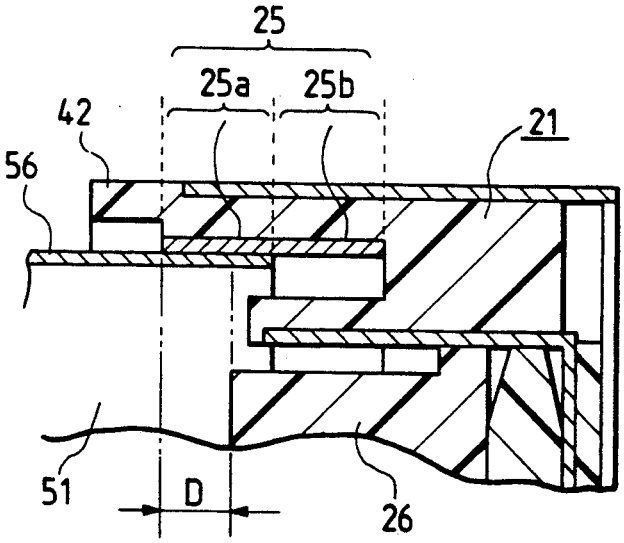
FIG. 16 is a sectional view partly showing the socket and the plug, for explaining a modified form of the present invention.

In the above embodiment, since the front end face of the body 51, in particular the front end face of the rectangular-sectioned tubular wall 67, is in line with the front marginal edge of the shield cover 56 of the plug, the plug guide portion 25*a* of the cylindrical member 25 of the socket is defined by a portion of a length D forwardly of the front end face of the columnar key 26 as shown in FIG. 13. As partly shown in FIG. 16, however, when the front marginal edge of the shield cover 56 of the plug protrudes more than the front end face of the body 51, the front marginal edge of the shield cover 56 enters deeply into the cylindrical member 25 in excess of the length D until the front end face of the columnar key 26 abuts against the front end face of the plug body 51, and accordingly, the plup guide portion 25*a* of the cylindrical member 25 is longer than the length D.

In the above, it is also possible, on the one hand, that the partition wall 29 of the columnar key of the socket is removed to render the slots 26*a* and 26*b* into a single large slot and, on the other hand, that the two support arms 68*a* and 68*b* of the plug are formed integrally with each other to provide a thick support arm which is fitted into the above slot.

As described above, according to the present invention, the partition walls 65 and 66 are provided between the signal contacts 53, 54 and the power supply contacts 55*a*, 55*b* in the plug and the forward end faces of the partition walls 65 and 66 lie forwardly of the forward ends of the contracts, so that even if a foreign object enters into the cylindrical member 56 of the plug, there is no possibility of shortening being caused by the foreign object between the power supply contacts 55*a*, 55*b* and the signal contacts 53, 54. In the foregoing embodiments in which the partition walls 65 and 66 support and reinforce the contacts 53 and 54, the contacts 53 and 54 may be narrow and thin. In the socket of the present invention into which the plug of the present invention is put, at least one contact support plate 27 or 28 is extended from the body 21 in the circular hole 24, the plurality of signal contacts 34 or 35 are housed in the grooves 34*a* or 34*b* cut in one side of the contact support plate 27 or 28, and the tip of the support plate lies forwardly of the tip ends of the signal contacts 34 or 35. Accordingly it is hard for foreign objects to adhere to the signal contacts and hard for shorting to occur. In the socket, the partition wall receiving grooves 45 and 46 are provided corresponding to the partition walls 65 and 66 of the plug, and when the partition walls 65 and 66 are received in the grooves 45 and 46 by putting the plug into the socket, substantially no outside air flows into the socket, and consequently, the signal contacts are kept clean.

It will be apparent that many modifications and variations may be effected without departing from the novel conceps of the present invention.

What is claimed is:

1. A plug, adapted to be connected to a socket, comprising:

a cylindrical metallic shield cover;

an insulating body mounted in said shield cover;

a first insulating partition wall integral with said body and disposed inside of said shield cover, said first partition wall extending forwardly of said body to a plane in which a front end of said shield cover lies, said first insulating partition wall havin a plurality of first housing grooves cut in a first side surface thereof to extend side by side axially forwardly;

insulating support arm means integral with said body and disposed adjacent to and spaced from a second side surface of said first partition wall opposite to said first side surface, said insulating support arm means extending forwardly from said body axially thereof to said plane, said insulating support arm means having second housing grooves cut in opposite side surfaces thereof;

power supply contacts extending axially through said body and in said second housing grooves with one side of each of said power supply contacts in said second housing grooves being exposed; and a plurality of signal contacts extending side by side through said body and in said first housing grooves with one side of each of said signal contacts in said first housing grooves being exposed;

a front end face of said first partition wall protruding further than tips of said signal contacts, and a front end face of said support arm means protruding further than tips of said power supply contacts.

2. The plug of claim 1 further including a second partition wall disposed inside of said cylindrical metallic shield cover in parallel and opposing relation to said first partition wall, and a plurality of second signal contacts extending through said insulating body in third housing grooves cut in a side surface of said second partition wall opposite from said support arm means, one side of each of said second signal contacts in said third housing grooves being exposed.

3. The plug of claim 2 wherein said first and second partition walls constitute two opposite side walls of a substantially square-sectioned tubular wall in which said support arm means and said power supply contacts are disposed.

4. The plug of claim 1 wherein said support arm means comprises first and second support arms extending forwardly from said body axially thereof, said first and second support arms having said second housing grooves cut in outer side surfaces thereof opposite from each other.

5. The plug of one of claims 2, 3 or 4 wherein first and second guide plates extend forwardly from said body axially thereof along the interior surface of said cylindrical shield cover opposite to said first and second partition walls and in spaced relation thereto.

6. A socket for receiving a plug which has partition wall means and support arm means extended from an insulating plug body along which a plurality of signal contacts and power supply contacts are supported, respectively, said socket comprising:

an insulating socket body having a circular hole therein which extends rearwardly from a front end of said insulating sockey body;

a cylindrical metallic member disposed in said circular hole;

a first support plate disposed inside of said cylindrical metallic member and extended forwardly from said insulating socket body axially thereof, said first support plate having a plurality of first housing grooves cut in a side surface of said first support plate to extend axially forwardly;

a columnar key disposed inside of said cylindrical metallic member in opposing and spaced relation to said side surface of said first support plate and extending axially forwardly from said insulating socket body to define a first space between said columnar key and said first support plate for receiving therein at least part of the partition wall means of said mating plug, said columnar key having slot formed therein to extend axially rearwardly from a front face of said columnar key;

a plurality of first signal contacts held in said first housing grooves with one side of each of said first signal contacts being exposed, tips of said first signal contacts being situated behind a front end of said first support plate; and power supply contacts held in second housing grooves cut in an inner wall surface of said slot means to extend axially forwardly, one side of each of said power supply contacts in said second housing grooves being exposed, tips of said power supply contacts being situated behind a front end of said columnar key;

said front end of said columnar key being situated rearwardly of a front end of said cylindrical metallic member and forwardly of said front end of said first support plate.

7. The socket of claim 6 wherein said columnar key is provided substantially on the center axis of said cylindrical metallic member, said socket further including a second support plate extending forwardly from said insulating socket body axially thereof in opposed and spaced relation to a side of said columnar key opposite from said first supportg plate to define a second space between said columnar key and said second support plate for receiving therein at least another part of the partition wall means of said mating plug, a plurality of second signal contacts held in a plurality of third housing grooves cut in a side surface of said second support plate with one side of each of said second signal contacts in said third housing grooves being exposed, tips of said second signal contacts being situated behind a front end face of said second support plate.

8. The socket of claim 6 or 7 wherein said slot means includes first and second slots formed separately of each other in said columnar key and extending rearward from said front face of said columnar key for receiving the support arm means of said mating plug.

* * * * *